United States Patent [19]

Kirch

[11] 3,977,602

[45] Aug. 31, 1976

[54] MOBILE SPRAY APPARATUS

[76] Inventor: Paul W. Kirch, 2325 Kellog Court, Altadena, Calif. 91001

[22] Filed: Oct. 29, 1974

[21] Appl. No.: 518,369

[52] U.S. Cl. ..... 239/74; 206/162; 214/372; 239/286; 239/308

[51] Int. Cl.[2] ..... B05B 7/24

[58] Field of Search ..... 239/146, 149, 286, 302, 239/303, 304, 307, 308, 375, 74; 222/176, 399; 248/97, 98, 128, 129, 310, DIG. 7; 206/201, 202, 162; 214/372, 374

[56] References Cited

UNITED STATES PATENTS

| | | | |
|---|---|---|---|
| 446,190 | 2/1891 | Post | 206/162 |
| 1,128,697 | 2/1915 | Levy | 239/308 X |
| 1,299,829 | 4/1919 | Goodyear | 214/372 |
| 2,772,921 | 12/1956 | Nance | 239/303 X |
| 3,028,043 | 4/1962 | Angstadt | 206/202 |
| 3,265,308 | 8/1966 | Hopkins | 239/286 X |
| 3,330,482 | 7/1967 | Crowe | 239/74 |
| 3,335,916 | 8/1967 | Juniper | 222/176 |

*Primary Examiner*—John J. Love
*Assistant Examiner*—Michael Mar
*Attorney, Agent, or Firm*—Jackson & Jones

[57] ABSTRACT

A variable pressure spray apparatus is provided having a pressurizable fluid storage vessel connected to a pressurized gas cylinder. The spray apparatus is self contained and does not require an external power supply. A hand pulled support cart is adapted to support a removable tray that is capable of carrying the storage vessel and the pressurized cylinder. The combination of the cart and tray with the spray apparatus permits an operator to carry his equipment with him to previously inconvenient and inaccessible locations with regards to conventional spray equipment.

7 Claims, 3 Drawing Figures

MOBILE SPRAY APPARATUS

BACKGROUND OF THE INVENTION

1. Field of the Invention

The present invention is directed to an airless pressure spray apparatus and more particularly to a mobile paint spray apparatus that can be hand carried.

2. Brief Description of the Prior Art

The advent of pressurized paint spraying has increased the efficiency and work output of the average painter. Generally, a compressor is attached to a paint container for introducing compressed air into the paint stream at the nozzle of the spray gun. This breaks up the paint particles into fine droplets for application to the object to be painted.

There have been suggestions in the prior art to eliminate the inconvenience of using an air compressor or hydraulic pumps in the paint spraying operation. For example, the Glaros U.S. Pat. No. 3,469,788 discloses an airless spray apparatus utilizing a high pressure fluid source, such as carbon dioxide preferably pressurized above 500 psi. The arrangements of the paint storage vessels and the pressurized gas cylinders are such that the pressurized fluid is not lost when the paint is exhausted but rather it is possible to replace the paint through a valving system.

The Kochner U.S. Pat. No. 2,631,891 and U.S. Pat. No. 3,197,144 are cited of general interest to disclose pressurized dispensing apparatus. Finally, the Wagner U.S. Pat. No. 3,515,355 is cited of general interest for its disclosure of various features of an airless spray gun. The prior art has not been able to provide a portable airless spray apparatus that fully meets the demands of the paint industry.

SUMMARY OF THE INVENTION

The pressure spray apparatus of the present invention includes a first pressure vessel adapted to contain a motive fluid and a second pressure vessel adapted to supply the paint to be sprayed. Conduit hoses are connected to and extend between the first and second pressure vessels whereby the pressurized motive fluid, such as $CO_2$, can force the paint through the nozzle of a spray gun.

The pressure spray apparatus further includes a support cart that can be conveniently hand pulled and a removable tray member supported by the cart. The tray member may include a plurality of ring members attached to the base and spaced relatively apart for retaining the pressure vessels on the cart. The tray can be hand lifted from the cart to accommodate the operative positioning of the pressure spray apparatus in locations not accessible by the cart.

The features of the present invention which are believed to be novel are set forth with particularity in the appended Claims. The present invention, both as to its organization and manner of operation, together with further objects and advantages thereof, may best be understood by reference to the following description, taken in connection with the accompanying drawings.

DESCRIPTION OF THE PREFERRED EMBODIMENT

With reference to the drawings and the following specification herein, the best mode of the invention presently contemplated by the inventor of carrying out his invention is set forth.

As may be appreciated by artisans in the field of spraying and painting, the problem of a portable hand carried spray apparatus for spraying a substantial amount of liquid, such as paint, has existed for a number of years. The support equipment, such as air compressors and hydraulic pumps are not only expensive, but are bulky and not readily transportable to meet the mobility requirements of the operator. Thus, there has been a need for a spray apparatus unit for painting or staining acoustical ceiling, exterior stucco, siding, overhang, block walls and fencing along with many other jobs that requires the operator or painter to continuallly change his location. Accordingly, the present invention provides a completely selfcontained, portable, airless paint spraying apparatus, which requires no compressor or auxiliary power of any kind. The present invention is relatively maintenance free and extremely easy to clean.

Figure 1:
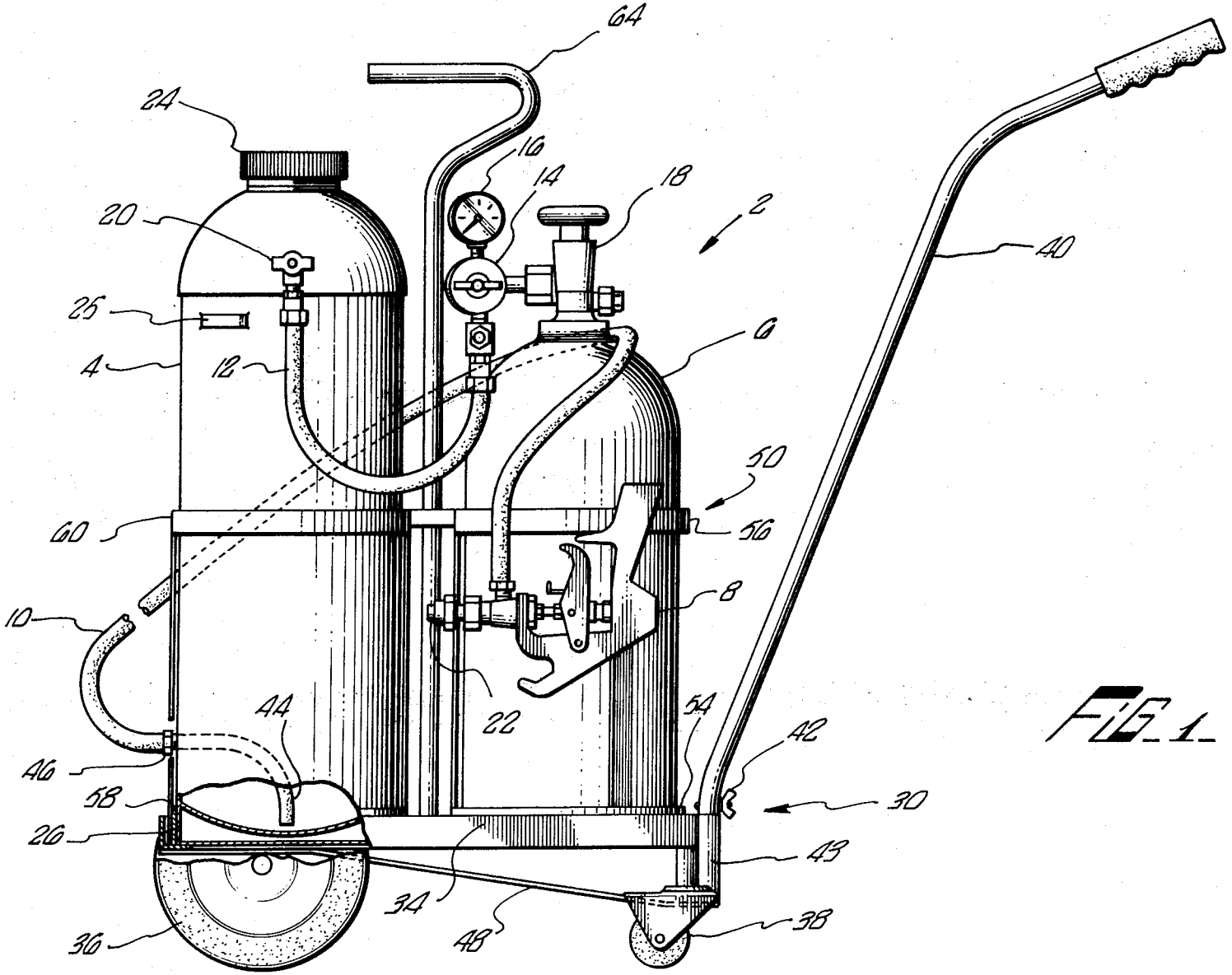
FIG. 1 is a side view partially cut away of the pressure spray apparatus of the present invention.

With reference to FIG. 1, the spray apparatus 2 of the present invention includes a paint tank or vessel 4 of stainless steel. The capacity of the paint tank 4 can be altered to meet any particular design requirements. The preferred embodiment as disclosed uses a three gallon tank. A pressurized CO2 cylinder tank 6 weighs approximately 10 lbs and is made from aluminum. The pressure capacity of the cylindrical tank 6 is capable of spraying from 20 to 30 gallons of liquid, such as paint, lacquer, stain, etc. without requiring a refill. Although, it is possible to increase the pressure range, the preferred mode of the invention will utilize between 150 and 300 psi of pressure which compares favorably when compared with the thousands of pounds of pressure generally required by other types of airless equipment.

A spray gun 8, for example, of the type disclosed in U.S. Pat. No. 2,956,752 is attached to the hose 10 which in turn is attached to a coupling member 46 on the lower side of the paint tank 4. An arcuate metal tube 44 extends into the interior of the paint tank 4 and terminates adjacent the concave bottom 28 of the tank 4. A peripheral skirt member 26 extends below the bottom 28 of the tank 4 for contacting a support surface.

A pressure line or conduit 12 extends between the $CO_2$ tank 6 and the paint tank 4. A valve 18 is mounted on top of the $CO_2$ cylinder 6 and is coupled to a pressure regulator 14 which is in turn connected to one end of the pressure line 12. Gauge 16 monitors the downstream pressure in the pressure line 12 from the pressure regulator 14. Relief valve 20 is attached to another end of the pressure line 12 and can be hand operated to release any pressure within the pressure line 12 and the paint tank 4. A wide mouth threaded top or cap 19 is adapted to close and seal the upper opening of the paint tank 4 and is sufficiently large to permit the introduction of paint or a similar liquid to be sprayed into the container 4.

Indication means are provided on the interior side wall of the paint tank 4 to provide an indication of a maximum fill level for the paint tank 4. In the preferred embodiment, the indication means comprises an extension from the surface of the side wall such as an indent protrusion 25, which will not be obscured when coated with paint. The indent protrusion can be located below but adjacent the connection of the relief valve 20 with the tank 4 side wall.

Since the spray apparatus 12 works at a relatively low pressure, e.g. between 150 psi and 300 psi, the nozzles 22 that are utilized on the spray gun 8 do not have to be replaced as frequently as nozzles utilized at higher pressures e.g. 500 psi and higher in spraying operations.

Figure 3:
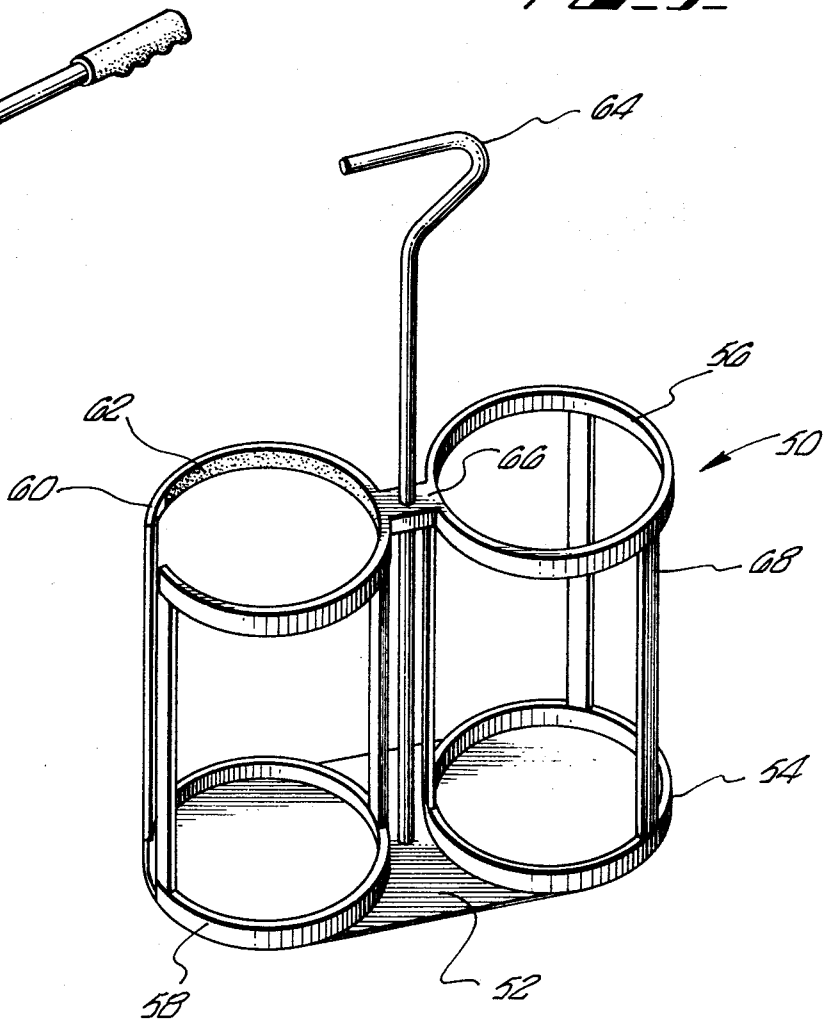
FIG. 3 is a perspective view of the tray of the present invention.
Figure 2:
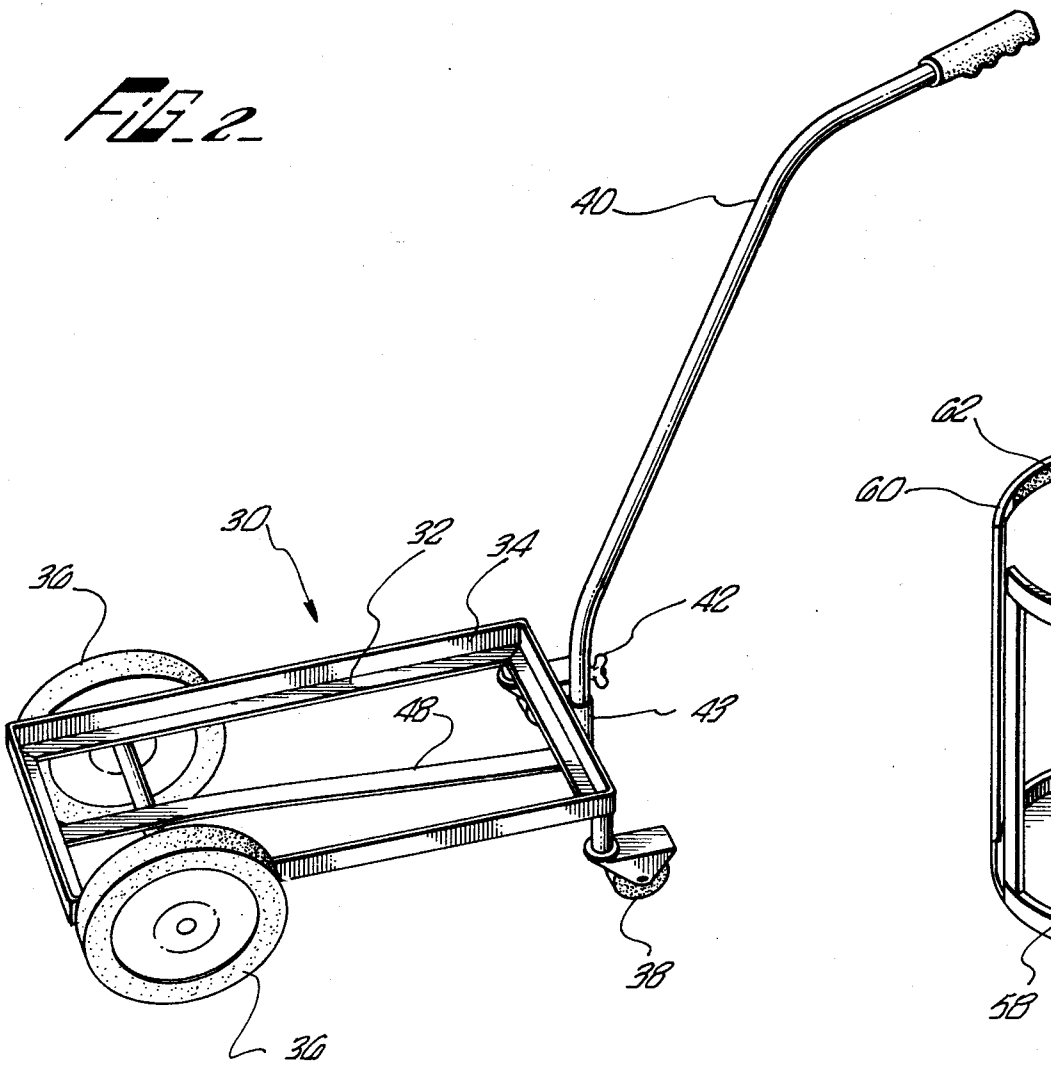
FIG. 2 is a perspective view of the cart of the present invention.

Referring to FIGS. 2 and 3, supporting cart 30 consists of a flat base 32 and a perimeter peripheral flange 34 mounted on a pair of rear fixed axle wheels 36 and a pair of forward swivel wheels 38. Each side of the support cart 30 is formed from a single length of an L-shaped metal flange that are collectively welded together to form the body of the cart 30. A central flat metal band 48 is attached to the front and rear sides of the support cart 30 and supports the bottom of a circular holder 43 that is adapted to receive the handle member 40. A fastener 42 is utilized to attach the handle member 40 to the holder 43.

The combination of the relatively large fixed axial wheels 36 and the smaller forward swivel wheels 38 provide both portability and easy maneuverability of the spray assembly 2. Thus, it is easy for an operator to pull the spray assembly 2 with one hand while directing the paint spray of the spray gun 8 at the desired object to be painted with the other hand. The operator is accordingly freed from any electrical connections or attachments to auxiliary power supplies.

A rack or tray member 50 is adapted to support and retain both the paint tank 4 and the $CO_2$ cylinder 6. The tray member 50 includes a sheet metal base plate 52 having an oblong circular shape adapted to fit within the peripheral flange 34 and to be supported upon the base 32 of the support cart 30. Welded onto the base plate 52, is a lower solid ring holder 54 and a lower split ring holder 58. Spaced upwardly from the lower ring holder and supported by respective support posts 68 are an upper solid ring holder 56 and an upper split ring holder 60. A connecting bracket 66 is attached to both the upper solid and split ring holders and further helps provide support for a manual handle shaft 64 that is attached between the ring holders 54 and 58 to the base plate 52.

The split ring holder 60 is adapted to accommodate the paint tank 4 while permitting the hose coupling member 46 to extend outward from the surface of the tank 4. The diameters of the respective ring holders are slightly larger than the circumferences of the respective tank 4 and $CO_2$ cylinder 6. The opening between the support post 68 and the upper split ring holder 60 easily accommodates the extension of the hose coupling member 46 and its connection to a paint hose 10. The internal surface of the upper split ring holder 60 is covered with a foam rubber pad 62 to lend additional support to the paint tank 4.

As can be readily appreciated, frequently when it is inconvenient to carry or transport the cart 30, the operator can utilize the handle 64 for lifting the paint tank 4 and $CO_2$ cylinder 6 as an operative entity and hand carrying it to the desired location. Generally, the paint hose 10 will comprise approximately 25 feet of hose and as can be appreciated, this will normally permit adequate mobility to the painter to paint the desired surface or object.

The operation of the present invention is described as follows. The paint hose 10 and spray gun 8 are attached to the coupling member 46 on the paint tank 4. The paint tank cap 24 is removed and the appropriate material, such as paint, is inserted into the paint tank 4. The indentation mark 25 that is impressed on the side wall of the paint tank 4, provides the painter with an indication of the maximum fill level for the paint. Thus, a readily identifiable level mark or means for indicating maximum fill position is provided that cannot be coated or covered by the paint. The cap 24 is securely fastened to the top of the paint tank 4 and the relief valve 20 is closed. Valve 18 on the top of the $CO_2$ pressurized cylinder 6 is opened and the pressure regulator 14 is adjusted to provide the maximum pressure desired as shown on the indicator or gauge 16. The spray assembly 2 is thus in an operative mode and a simple depression of the trigger of the spray gun 8 then commences the spraying of the material.

The paint tank 4 and the pressurized cylinder 6 are mounted within the tray member 50 which is in turn supported upon the support cart 30. The entire assembly weighs approximately 50 lbs and is easily transportable by the operator. The length of the paint hose 10 permits the operator a certain degree of freedom independent of the support cart 30. The support cart 30 however, is readily transportable and can be pulled by the operator with a minimum of effort. The swivel wheels 38 provide mobility with a minimum of friction while the larger fixed axial wheels 36 permit the movement of the support cart 30 over obstacles, such as steps and building material that are frequently encountered by the painter. When necessary, the operator can remove the tray member 50 supporting the paint tank 4 and the pressurized cylinder 6 by simply lifting it via the handle 64 and physically carrying the assembly to the situs of the paint operation.

Although basically, only one embodiment of the invention has been described, it should be realized that other embodiments may be created using the inventive concept outlines above and therefore the present invention should not be limited by the above specification, but only by the appended Claims.

What is claimed is:

1. A mobile pressure spray apparatus comprising:

a first pressure vessel adapted to contain a motive source;

a second pressure vessel adapted to contain a fluid such as paint to be sprayed;

conduit means connected to and extending between the first and second pressure vessels for supplying the motive source to the second pressure vessel for pressurizing the fluid;

means for spraying the fluid; and means for transporting the first and second pressure vessels as an operative mobile unit including a wheeled support cart and a removable tray member adapted to retain the first and second pressure vessel thereon and to permit their unitary removal from the support cart as a combined operative unit, the tray member further including a base plate and a plurality of ring retainer members attached to the base plate and spaced respectively apart, the ring members being aligned to receive and laterally retain the first and second pressure vessels, at least one ring retainer being split to provide an opening therein to permit the passage of the means for spraying the fluid.

2. A mobile pressure spray apparatus as in claim 1 further including indication means on the inside surface of the second pressure vessel for indicating a maximum fill level of fluid.

3. A mobile pressure spray apparatus as in claim 2 wherein the indication means is a protruding member extending into the cavity of the second pressure vessel.

4. A mobile pressure spray apparatus as in claim 1 wherein the conduit means connected to and extending between the first and second pressure vessels includes a pressure relief valve.

5. A mobile pressure spray apparatus as in claim 1 wherein at least one of the retainer members has a resilient pad mounted thereon to contact a pressure vessel.

6. In a mobile pressure spray apparatus for spraying fluid such as paint having a first and second pressure vessel, and means for spraying the fluid, the first pressure vessel containing a pressurized gas while the second pressure vessel contains the fluid to be sprayed, the vessel being fluidally connected together so that the pressurized gas can expel the fluid from the second vessel, the improvement comprising:

a support cart having a support surface, and a tray member supported and removably retained on the support surface including a base plate and a plurality of ring retainer members attached to the base plate and spaced respectively apart, the ring members being aligned to receive and laterally retain the first and second pressure vessels, at least one ring retainer being split to provide an opening therein to permit the passage of the means for spraying the fluid.

7. The invention of claim 6 wherein at least one of the retainer members has a resilient pad mounted thereon to contact a pressure vessel.

* * * * *